US006609404B1

(12) United States Patent
Gray

(10) Patent No.: US 6,609,404 B1
(45) Date of Patent: Aug. 26, 2003

(54) TOOL FOR LOCALLY FORMING A HORIZONTAL WORKPIECE

(75) Inventor: Luke George Mark Gray, Waterloo (CA)

(73) Assignee: Babcock & Wilcox Canada, Ltd., New Orleans, LA (US)

( * ) Notice: Subject to any disclaimer, the term of this patent is extended or adjusted under 35 U.S.C. 154(b) by 0 days.

(21) Appl. No.: 10/180,694

(22) Filed: Jun. 26, 2002

(51) Int. Cl.[7] ..... B21D 41/02; B21D 15/00

(52) U.S. Cl. ..... 72/392; 72/105; 72/110; 72/705

(58) Field of Search ..... 72/100, 105, 110, 72/121, 302, 370.01, 370.04, 370.06, 370.08, 370.1, 370.24, 392, 393, 420, 705; 254/93 R

(56) References Cited

U.S. PATENT DOCUMENTS

| | | | | |
|---|---|---|---|---|
| 3,817,079 A | | 6/1974 | Priester | |
| 3,961,516 A | * | 6/1976 | Priester | 72/370.08 |
| 4,400,968 A | | 8/1983 | Barbieri | |
| 4,415,021 A | | 11/1983 | Bayless et al. | |
| 4,571,980 A | * | 2/1986 | Goodwin | 72/381 |
| 4,756,644 A | | 7/1988 | Williams | |
| 4,803,881 A | * | 2/1989 | Dudley | 72/392 |
| 4,949,569 A | | 8/1990 | Young et al. | |
| 4,974,440 A | * | 12/1990 | Brinegar | 72/392 |
| 5,676,009 A | | 10/1997 | Bright et al. | |
| 5,946,965 A | * | 9/1999 | Leone | 72/392 |

OTHER PUBLICATIONS

*Steam*, Its Generation and Use, 40th Edition, The Babcock & Wilcox Company, ©1992, pp. 38–1 to 38–11 and pp. 52–1 to 52–9.

* cited by examiner

*Primary Examiner*—Ed Tolan
(74) *Attorney, Agent, or Firm*—Kathryn W. Grant; Eric Marich

(57) ABSTRACT

A forming or re-rounding machine has opposed inner and outer hydraulic ram sets each carried in a housing with rollers. The ram set housings are movably mounted onto an I-beam frame connected by hydraulic cylinders. The frame supports a can or shell for rotation of the surface to position a region for forming or reforming between the hydraulic ram sets. Each ram set has a hydraulic cylinder for advancing a re-forming tool on either the inside or outside of the can or shell to reform the selected region. The I-beam hydraulic cylinders are allowed to compress when the can or shell is positioned for forming or reforming and help prevent flexing of the can or shell outside the selected region.

14 Claims, 3 Drawing Sheets

TOOL FOR LOCALLY FORMING A HORIZONTAL WORKPIECE

FIELD AND BACKGROUND OF INVENTION

The present invention relates generally to the field of forming or re-rounding metal cans and shells and in particular to a new and useful hydraulic re-forming tool for providing a cylinder with a round shape.

Relatively large metal shells and cans are used as coverings to protect mechanical and electrical devices and provide a uniform appearance, and as components of thick-walled pressure vessels. Often, these shells and cans must have a perfectly round, or circular, shape in order to fit as intended.

For a general description of methods of making pressure vessels, the reader is referred to Chapters 38 and 52 of *Steam/Its Generation and Use*, 40th Edition, The Babcock and Wilcox Company, Barberton, Ohio, U.S.A., ©1992, the text of which is hereby incorporated by reference as though fully set forth herein.

In addition, metal shells and cans can become deformed due to contact with heavy objects or from damage that occurs during manufacturing or shipping. As a result, it is necessary to re-form the shells and cans into a perfectly round cylinder again.

Prior methods for forming or re-rounding metal shells and cans include hitting the cans with an uncontrolled hammer, re-rolling the cans in a rolling machine and pressing the shell or can from the inside curvature with a single post and ram device.

The prior methods and devices are unsatisfactory because they are inaccurate and can affect other regions of the cans and shells besides those being formed or re-rounded. Flexing of the entire can, including areas not being formed or re-rounded, can occur as a result of using each of the prior devices, since a small area cannot be worked in isolation. As a result, one can end up chasing a deformation around the can in what is known as "radial chasing." (So-called "axial chasing", along the length of the can, tends to be minimal.) Further, prior devices require significant mechanical force, especially to form or re-round large, thick-walled cans. As a result, the prior devices are somewhat unsafe due to the nature of the forces being applied to the cans and shells.

SUMMARY OF THE INVENTION

It is an object of the present invention to provide a forming or re-rounding machine which is safer to use than known machines.

A further object of the invention is to provide a forming or re-rounding machine which does not adversely affect other sections of a can or shell being formed or re-rounded.

Accordingly, a forming or re-rounding machine is provided having opposed inner and outer hydraulic ram sets each carried in a housing with rollers. The ram set housings are movably mounted onto an I-beam frame connected by hydraulic cylinders. The frame supports a can or shell for rotation of the surface to position a region for forming or re-forming between the hydraulic ram sets. Each ram set has a hydraulic cylinder for advancing a forming or re-forming tool on either the inside or outside of the can or shell to reform the selected region. The I-beam hydraulic cylinders are allowed to compress when the can or shell is positioned for forming or re-forming and help prevent flexing of the can or shell outside the region being formed or re-formed.

The safety of the device is increased over known forming or re-forming machines, since once the can or shell is positioned properly, the frame hydraulic cylinders are compressed to hold the can, followed by expanding either the inner or outer ram set hydraulic cylinder.

In one embodiment the invention is a machine for forming a workpiece, comprising a pair of upper I-beams and a pair of lower I-beams. The machine includes at least a pair of connecting plates, at least one of the pair of connecting plates rigidly securing the pair of upper I-beams together, and at least the other of the pair of connecting plates rigidly securing the lower I-beams together. At least two frame hydraulic cylinders are connected between the at least a pair of connecting plates to movably join the pair of upper I-beams and pair of lower I-beams together adjacent one end to form a frame having the other end open for receiving the workpiece, the at least two frame hydraulic cylinders for moving the upper and lower I-beams closer together or farther apart. The machine further includes an upper housing movably mounted on the pair of upper I-beams and a lower housing movably mounted on the pair of lower I-beams. A pair of hydraulic ram sets, with one hydraulic ram set mounted in each of the upper and lower housings, are positioned over a selected section of the workpiece and arranged to contact the respective outer or inner side of the workpiece at the selected section.

In another embodiment the invention is a machine for providing a cylindrical workpiece with a round circumference, comprising a pair of upper I-beams and a pair of lower I-beams. The machine includes at least a pair of connecting plates at least one of the pair of connecting plates rigidly securing the pair of upper I-beams together, and at least the other of the pair of connecting plates rigidly securing the lower I-beams together. At least two frame hydraulic cylinders are connected between the at least a pair of connecting plates to movably join the pair of upper I-beams and pair of lower I-beams together adjacent one end to form a frame having the other end open for receiving the workpiece, the at least two frame hydraulic cylinders for moving the upper and lower I-beams closer together or farther apart. The machine further includes an upper housing movably mounted on the pair of upper I-beams, and a lower housing movably mounted on the pair of lower I-beams. A pair of hydraulic ram sets, with one hydraulic ram set mounted in each of the upper and lower housings, are positioned over a selected section of the workpiece and arranged to contact the respective outer or inner side of the workpiece at the selected section. Positioning rollers mounted in each of the upper and lower housings permit movement of the upper and lower housings along the upper and lower pairs of I-beams from the open end to the at least a pair of connecting plates. Contact rollers are mounted to each of the upper and lower pairs of I-beams for contacting the workpiece when the I-beams are moved together.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
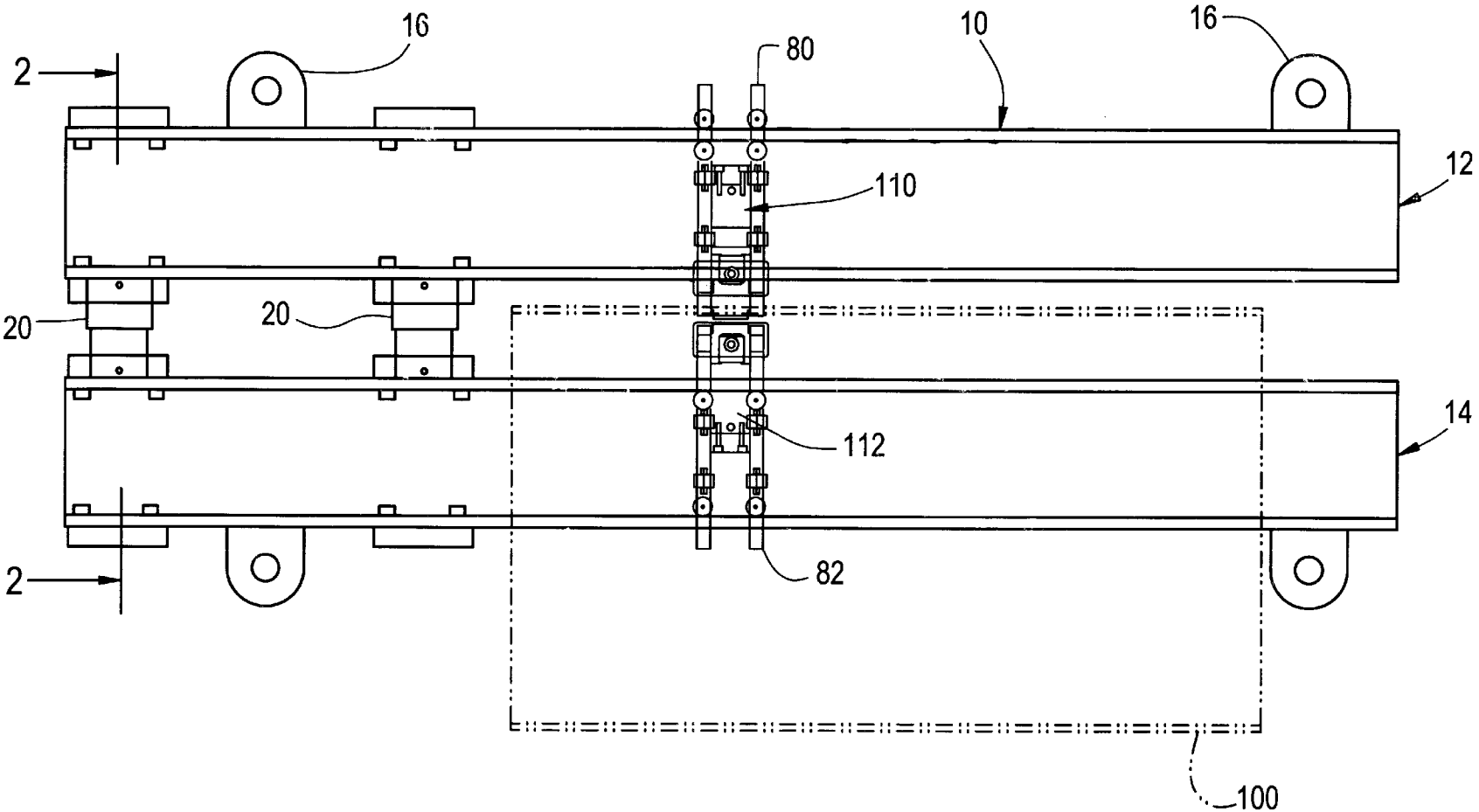
FIG. 1 is a side elevational view of the forming or re-rounding machine of the invention illustrating the position of a can being formed or re-rounded in phantom lines.

Referring now to the drawings, in which like reference numerals are used to refer to the same or similar elements, FIG. 1 shows a forming or re-rounding machine for arcuate or cylindrical workpieces, such as cans and metal shells, having an I-beam frame 10 composed of two sets of upper and lower I-beams 12, 14 (only one set shown in FIG. 1) biased apart at one end by hydraulic cylinders 20. A workpiece 100 to be formed or re-rounded, such as a can or shell, is inserted between upper and lower I-beams 12, 14 at the opposite end. Lifting lugs 16 are provided on each of upper and lower I-beams 12, 14 for transporting the frame 10 to workpiece 100. The above arrangement allows the workpiece 100 to be brought to the forming or re-rounding machine, or for the forming or re-rounding machine to be brought to the workpiece 100, for quick and efficient operation. The frame 10 supports a pair of ram sets 110, 112, for impacting the outer and inner surfaces of workpiece 100, respectively.

Figure 5:
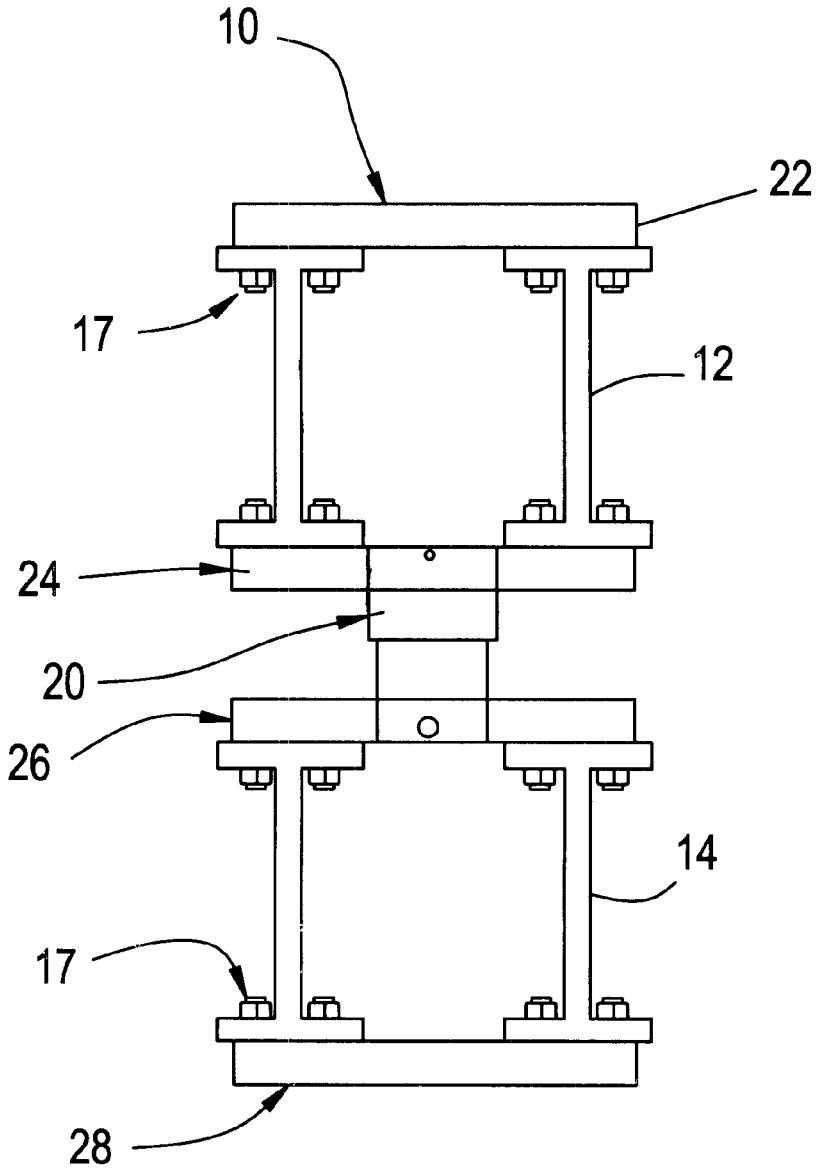
FIG. 5 is a sectional end elevational view taken along line 2—2 of FIG. 1.

FIG. 5 best illustrates the connection between upper and lower I-beams, 12, 14. Connector plates 22, 24, 26, 28 are secured to I-beams using bolts 17. Hydraulic cylinders 20 are mounted between connector plates 24, 26 for expanding to push the length of the I-beams 12, 14 apart, or compressing to bring the I-beams 12, 14 together. The hydraulic cylinders 20 are sized to permit a wide range of can and shell thicknesses to fit between connector plates 24, 26.

Figure 3:
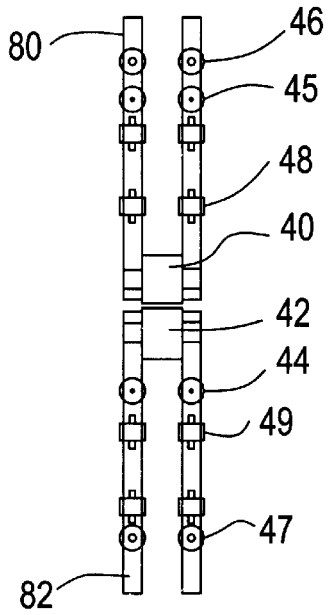
FIG. 3 is a sectional side elevational view of the frame taken along line 3—3 of FIG. 2.
Figure 4:
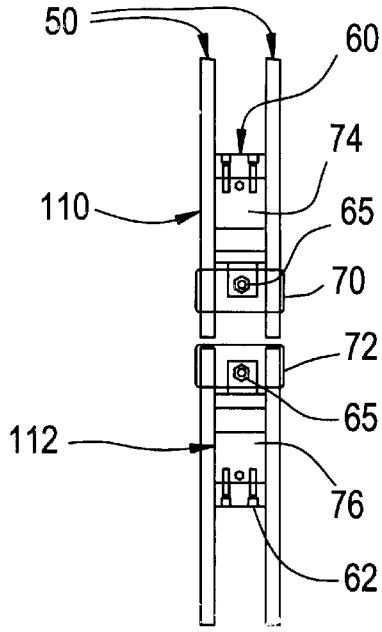
FIG. 4 is a sectional side elevational view of the ram sets taken along line 4—4 of FIG. 2.
Figure 2:
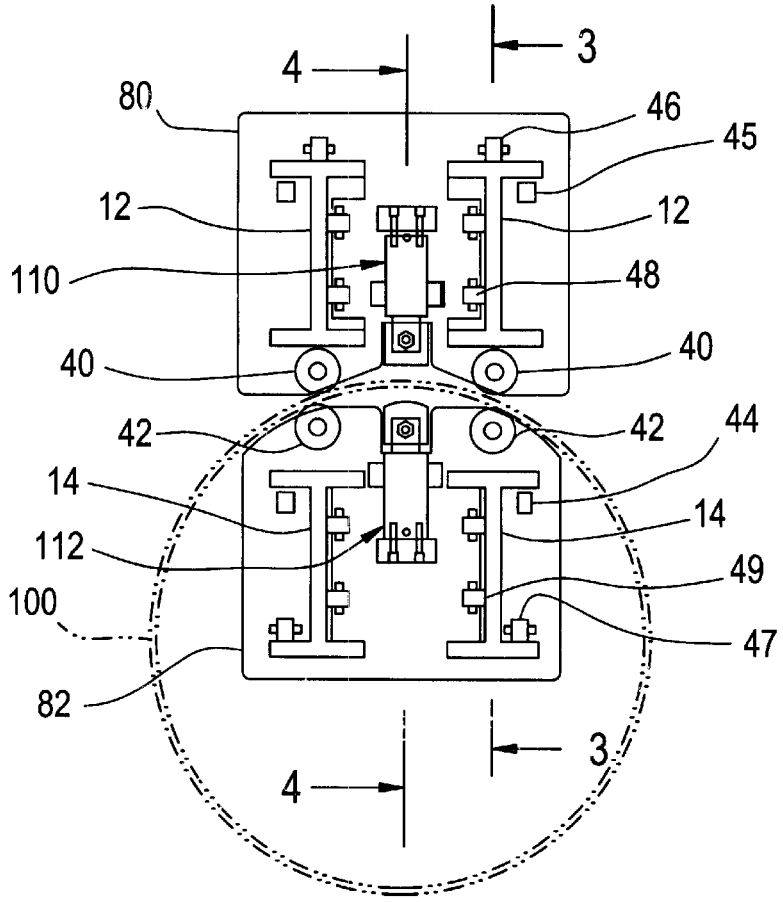
FIG. 2 is an end elevational view of the forming or re-rounding machine of FIG. 1.

Turning now to FIGS. 2–4, the forming or re-rounding machine is seen from the open end, with workpiece 100 positioned for forming or re-rounding illustrated in phantom. Housings 80, 82 are mounted on the two sets of upper and lower I-beams 12, 14 of the frame 10. Hydraulic ram sets 110, 112 may be positioned opposing each other on the outer and inner sides of workpiece 100 inside housings 80, 82. Hydraulic ram sets 110, 112 may be positioned offset from each other to prevent axial deformation, thereby avoiding "axial chasing." Can contact rollers 40, 42 are provided between upper and lower I-beams 12, 14 for contacting the workpiece 100 when it is positioned for re-rounding a specific region between the ram sets 110,112.

Positioning rollers 44, 45, 46, 47, 48, 49 are provided in the housings 80, 82 to floatingly support the housings 80, 82 on the frame 10. Positioning rollers 44–49 permit the ram sets 110, 112 to be aligned over a particular section along the length of the workpiece 100 once it has been rotated through contact rollers 40, 42.

Upper and lower ram sets 110, 112 each have a ram hydraulic cylinder 74, 76 connected to a ram pad 70, 72 by bolts 65. The upper and lower ram sets 110, 112 are mounted between sandwich plates 50 of the housings 80, 82.

The forming or re-rounding machine of the invention provides the advantage that the upper and lower ram sets 110, 112 may be positioned relative to a section of the workpiece 100 for forming or re-rounding using the contact rollers 40, 42 and positioning rollers 44–49 either locally or remotely. Then, once upper and lower ram sets 110,112 are aligned with the section of workpiece 100 section to be formed or re-rounded, the area around the machine can be cleared of personnel. The ram hydraulic cylinders 74, 76 are activated as needed to form or re-round the workpiece 100, pressing off against, backup or support plates 60, 62 located behind ram sets 110, 112. Thus, the safety factor of the machine is increased over other known techniques since the ram sets 110, 112 do not have to be readied by operating personnel.

Further, once the workpiece 100 is mounted in the I-beam frame 10, the housings 80, 82 with the ram sets 110, 112 can be moved in conjunction with rotation of the workpiece 100 to position the area for forming or re-rounding, simplifying the procedure. Even further, all rollers can be driven to remotely operate the process. The rollers 40, 42 also help prevent flexion in other parts of the workpiece 100 when ram sets 110, 112 are activated.

Although FIGS. 1, 2, and 4 show only two pairs of ram sets 110, 112, multiple pairs of ram sets could be used, for example to minimize horizontal movement. Further, although FIGS. 1, 2, and 4 show a pair of ram sets 110, 112 aligned and positioned in the same plane, one or more pairs of ram sets 110, 112 could be staggered or otherwise arranged about the workpiece 100 to move the workpiece into any desired form.

While a specific embodiment of the invention has been shown and described in detail to illustrate the application of the principles of the invention, it will be understood that the invention may be embodied otherwise without departing from such principles.

For example, while the forming or re-rounding tool described above is well-suited for forming a round shape from an out-of-round shape, it is also well-suited to produce an out-of-round shape from a round shape. Also, the above tool can be useful in producing boss marks on a workpiece such as a can or plate.

What is claimed is:

1. A machine for forming a workpiece, comprising:

a pair of upper I-beams;

a pair of lower I-beams;

at least a pair of connecting plates, at least one of the pair of connecting plates rigidly securing the pair of upper I-beams together, and at least the other of the pair of connecting plates rigidly securing the lower I-beams together;

at least two frame hydraulic cylinders connected between the at least a pair of connecting plates to movably join the pair of upper I-beams and pair of lower I-beams together adjacent one end to form a frame having the other end open for receiving the workpiece, the at least two frame hydraulic cylinders for moving the upper and lower I-beams closer together or farther apart;

an upper housing movably mounted on the pair of upper I-beams;

a lower housing movably mounted on the pair of lower I-beams; and a pair of hydraulic ram sets, one hydraulic ram set mounted in each of the upper and lower housings for positioning over a selected section of the workpiece and arranged to contact the respective outer or inner side of the workpiece at the selected section.

2. A machine according to claim 1, further comprising positioning rollers mounted in each of the upper and lower housings for permitting movement of the upper and lower housings along the upper and lower pairs of I-beams from the open end to the at least a pair of connecting plates.

3. A machine according to claim 2, wherein each hydraulic ram set comprises an hydraulic cylinder connected to a ram pad, the ram pad oriented to contact the workpiece.

4. A machine according to claim 2, further comprising contact rollers mounted to each of the upper and lower pairs of I-beams for contacting the workpiece when the I-beams are moved together.

5. A machine according to claim 1, wherein each hydraulic ram set comprises a hydraulic cylinder connected to a ram pad, the ram pad oriented to contact the workpiece.

6. A machine according to claim 1, further comprising contact rollers mounted to each of the upper and lower pairs of I-beams for contacting the workpiece when the I-beams are moved together.

7. The machine according to claim 1, further comprising a plurality of pairs of hydraulic ram sets.

8. The machine according to claim 7, wherein the pairs of hydraulic ram sets are aligned directly opposite each other.

9. The machine according to claim 7, wherein the pairs of hydraulic ram sets are aligned offset from each other.

10. A machine for providing a cylindrical workpiece with a round circumference, comprising:

a pair of upper I-beams;

a pair of lower I-beams;

at least a pair of connecting plates, at least one of the pair of connecting plates rigidly securing the pair of upper I-beams together, and at least the other of the pair of connecting plates rigidly securing the lower I-beams together;

at least two frame hydraulic cylinders connected between the at least a pair of connecting plates to movably join the pair of upper I-beams and pair of lower I-beams together adjacent one end to form a frame having the other end open for receiving the workpiece, the at least two frame hydraulic cylinders for moving the upper and lower I-beams closer together or farther apart;

an upper housing movably mounted on the pair of upper I-beams;

a lower housing movably mounted on the pair of lower I-beams;

a pair of hydraulic ram sets, one hydraulic ram set mounted in each of the upper and lower housings for positioning over a section of the workpiece and arranged to contact the respective outer or inner side of the workpiece at the section;

positioning rollers mounted in each of the upper and lower housings for permitting movement of the upper and lower housings along the upper and lower pairs of I-beams from the open end to the at least a pair of connecting plates; and contact rollers mounted to each of the upper and lower pairs of I-beams for contacting the workpiece when the I-beams are moved together.

11. A machine according to claim 10, wherein each hydraulic ram set comprises an hydraulic cylinder connected to a ram pad, the ram pad oriented to contact the workpiece.

12.The machine according to claim 10, further comprising a plurality of pairs of hydraulic ram sets.

13. The machine according to claim 12, wherein the pairs of hydraulic ram sets are aligned directly opposite each other.

14. The machine according to claim 12, wherein the pairs of hydraulic ram sets are aligned offset from each other.

* * * * *